United States Patent [19]

Duclos

[11] Patent Number: 4,468,034

[45] Date of Patent: Aug. 28, 1984

[54] GOLF CLUB LOFT AND LIE ANGLE INDICATING DEVICE

[76] Inventor: Clovis R. Duclos, 6327 Marina Pacifica Dr., Long Beach, Calif. 90803

[21] Appl. No.: 467,019

[22] Filed: Feb. 16, 1983

[51] Int. Cl.[3] ..... A63B 69/36

[52] U.S. Cl. ..... 273/183 D; 73/432 R; 33/174 F; 273/186 D; 273/194 A

[58] Field of Search ..... 273/186 A, 194 A, 183 D, 273/186 C, 186 D; 434/252; 73/432 R; 33/174 F

[56] References Cited

U.S. PATENT DOCUMENTS

| | | | |
|---|---|---|---|
| 3,523,689 | 8/1970 | Cornell et al. | 273/176 L |
| 3,667,761 | 6/1972 | Palotsee | 273/194 A X |
| 3,687,459 | 8/1972 | Swords | 273/194 A X |
| 3,999,764 | 12/1976 | Nitsche | 273/176 A X |
| 4,139,198 | 2/1979 | Kanavas | 273/186 A |
| 4,167,266 | 9/1979 | Tabicman | 273/176 A X |
| 4,355,809 | 10/1982 | Swett | 273/183 D |

*Primary Examiner*—George J. Marlo
*Attorney, Agent, or Firm*—George W. Finch

[57] ABSTRACT

An adjustment and training aid for golf clubs which allows the adjustment of the loft and lie angles for the physical characteristics and stance of a particular golfer. The device includes a base with a raised abutment surface on a horizontal platform against which the leading edge of the head of the club to be adjusted is positioned. With the golfer in his normal stance holding the club stationary against the abutment surface, a pointer of adjustable length is attached to the face of the club. The pointer is extended to an upstanding wall of the base having indicia thereon of loft and lie angles for the various clubs to indicate the actual loft angle and the direction a ball being hit would travel. Any misalignment of the expected ball direction from a centerline indicates an error in the lie angle of the club as it is being held.

17 Claims, 5 Drawing Figures

GOLF CLUB LOFT AND LIE ANGLE INDICATING DEVICE

BACKGROUND OF THE INVENTION

Each individual golfer, because of physical differences, should have his clubs adjusted as to loft and lie angles so that when taking a normal stance addressing the ball, the club head is in proper position to strike the ball in the desired direction with the proper loft. Club bending devices are available for adjusting the lie and loft angles of golf clubs and are used extensively in professional golf shops. The bending devices usually include a vise-type clamping device and a bending lever. The club is secured in the vise clamp and the bending lever is placed over the hosel of the club. The adjuster then makes slight bends in the hosel in an attempt to produce the correct lie and loft angles. Unfortunately, the adjuster usually must set the angles to published standards for various manufacturers and these standards, in most cases, are not correct for an individual's physical size and build. Therefore, even though the clubs have been adjusted properly, they are adjusted to a standard which an individual golfer may not meet.

Attempts to personally fit an individual have heretofore depended upon the not too accurate eye or judgement of the adjuster or extensive trial and error. Neither is particularly satisfactory. Therefore, there has been a need to provide a device by which it is possible to measure and correct the loft and lie angles of golf clubs when they are being held by their intended user so that the clubs can be adjusted quickly and accurately to any idiosyncrasies in a golfer's stance. In some cases, it is the stance which should be changed or a combination of both, yet heretofore there has been no device useful with the golfer's own clubs to show accurately the effect of stance errors so that the golfer's mental picture of a correct stance can be changed.

BRIEF DESCRIPTION OF THE PRESENT INVENTION

The present invention includes a base member and a removable, adjustable length pointer. The base has a horizontal platform with an upwardly extending alignment ledge for abutment with the club head. When adjusting a golf club, the owner is invited to address an imaginary ball which appears on the platform just beyond the alignment ledge. Therefore, the golfer positions the leading edge of the club head in abutment with the ledge to fix the geometry of that line. Once the golfer has attained his normal comfortable stance for a particular club, the pointer is attached to the face of his club. The pointer may be attached by any suitable means such as by a magnet or releasable adhesive in its base. The base surface of the pointer attached to the face is perpendicular to the extending portion of the pointer and hence the club head face. The pointer then is adjusted in length until its point touches an upstanding panel positioned at right angles to the platform which is a portion of the base. Indicia on the upstanding panel provide an indication of the proper loft angles for a particular club whereas errors in lie can be determined by offset of the point from a desired centerline.

By adjusting both the loft and lie angles of the club through bending of its hosel, the face of the club can be positioned to hit a golf ball properly as indicated by the position of the pointer after adjustment. In some cases, the error found will be a function of faulty stance rather than the club configuration and, in those cases, the present invention can be used to accustom a golfer to what a correct stance should look like with each of his clubs. It thus provides an instant lesson on proper ball address.

Therefore an object of the present invention is to provide means for quickly and easily adjusting the loft and lie angles of golf clubs to a particular golfer's physical characteristics and stance.

Another object is to provide means for indicating the loft and lie of a particular golf club without injury thereto so that the club later can be used for normal golf.

Another object is to provide means to teach a golfer what a proper address of a golf ball should look like with his own clubs.

Another object is to provide economical and easy to use measuring means for measuring the loft and lie angles present in a club when positioned by its intended user.

These and other objects and advantages of the present invention will become apparent to those skilled in the art after considering the following detailed specification in conjunction with the accompanying drawings wherein:

DETAILED DESCRIPTION OF THE SHOWN EMBODIMENT

Figure 1:
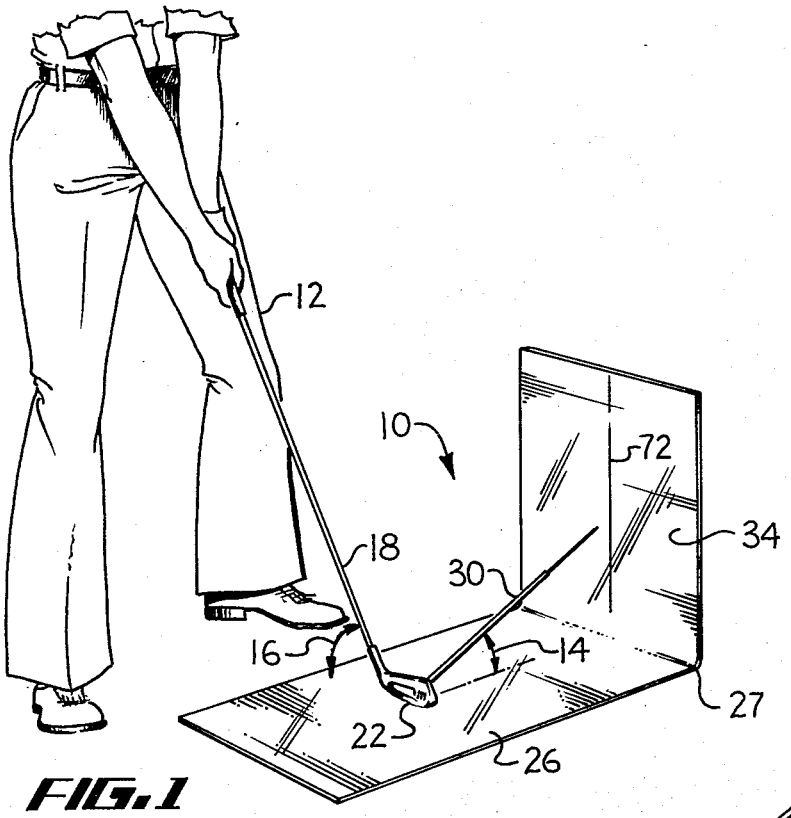
FIG. 1 is a perspective view of the present invention being used to indicate to a golfer his loft and lie angle.

Referring to the drawings more particularly by reference numbers, number 10 in FIG. 1 refers to a golf club measuring device constructed according to the present invention being used by a golfer 12 to indicate the actual loft angle 14 and the lie angle 16 error of a golf club 18.

The golfer 12 uses the device 10 by assuming his normal stance adjacent the device 10 with the lower leading edge 20 of the head 22 of the club 18 in abutment and square to an abutment ledge 24 which is positioned to stand upwardly from a horizontal platform 26 of a base member 27 (FIG. 2) with the sole 28 of the club 18 resting on the horizontal platform. Once the golfer 12 has addressed the imaginary ball 29 printed on the platform 26 by assuming what he believes is his normal alignment and stance with a particular club 18, in this case a 5 iron, a pointer member 30 is connected to the face 32 of the club head 22. The tip 32 of the pointer member 30 is extended to engage an indicia wall portion 34 of the base member 27 which extends upwardly at generally a right angle to the horizontal platform 26.

Figure 2:
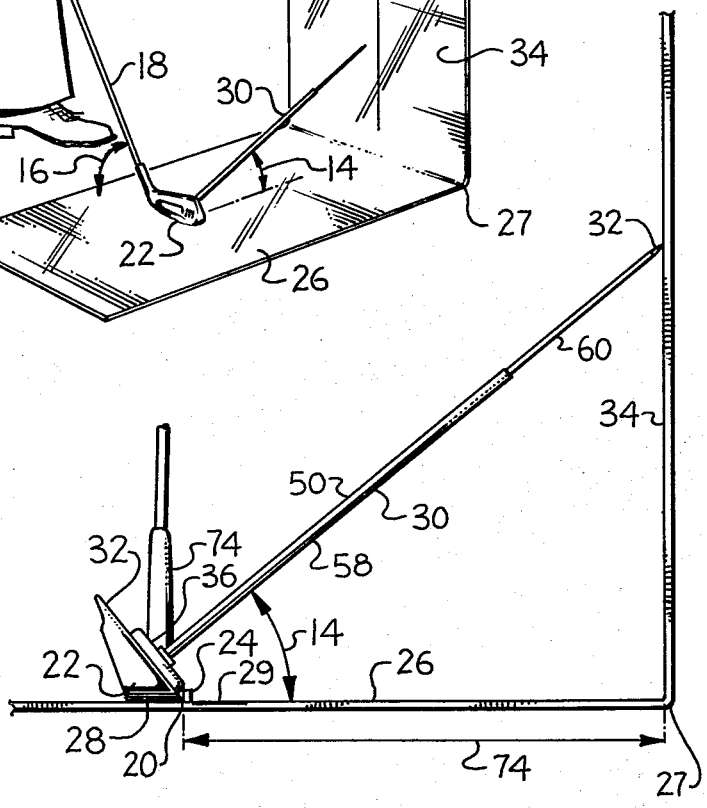
FIG. 2 is an enlarged side elevational view of the device of FIG. 1.
Figure 3:
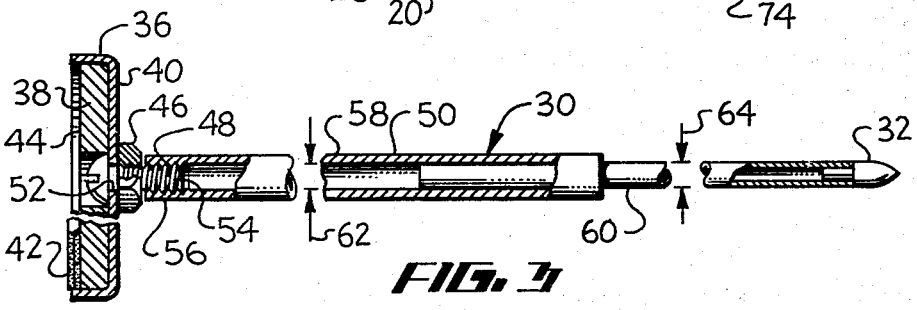
FIG. 3 is an enlarged partial cross-sectional view of the pointer used for the present invention.

The details of a preferred pointer member 30 are shown in FIG. 3. The pointer 30 includes a base cup 36 having retained therein a disc 38 of magnetic material by suitable means such as adhesive 40. Preferably the cup 36 is constructed from ferrous material that is magnetized by the permanent magnet disc 38 so that when it is brought in contact with the face 32 of the club head 22 as shown in FIG. 2, it is retained thereto by attractive magnetic force. Should the club head 22 be constructed from materials which are insensitive to magnetic forces, a thin disc 42 of double-sided adhesive tape can be placed on the face 44 of the magnetic disc 38 so that the pointer 30 is adhesively retained to the face of the club when positioned thereon.

Suitable retention means such as a nut 46 and bolt 48 are used to retain a pointer portion 50 to the cup 36. This is accomplished by passing the bolt 48 through a centrally located hole 52 in the cup 36 and disc 38, and fastening the screw 48 to the cup 36 by tightening the nut 46. Thereafter the outwardly extending end portion 54 of the bolt 48 is threadably engaged with the innermost end 56 of the pointer portion 50.

The pointer portion preferably is constructed from two telescoping pieces of tubing 58 and 60 with the inner diameter 62 of the tubing 58 being properly sized to the outer diameter 64 of the tubing 60 so that the two telescope together as shown. The tip 32 can be an especially machined part or merely can be the refill of a pen.

Figure 4:
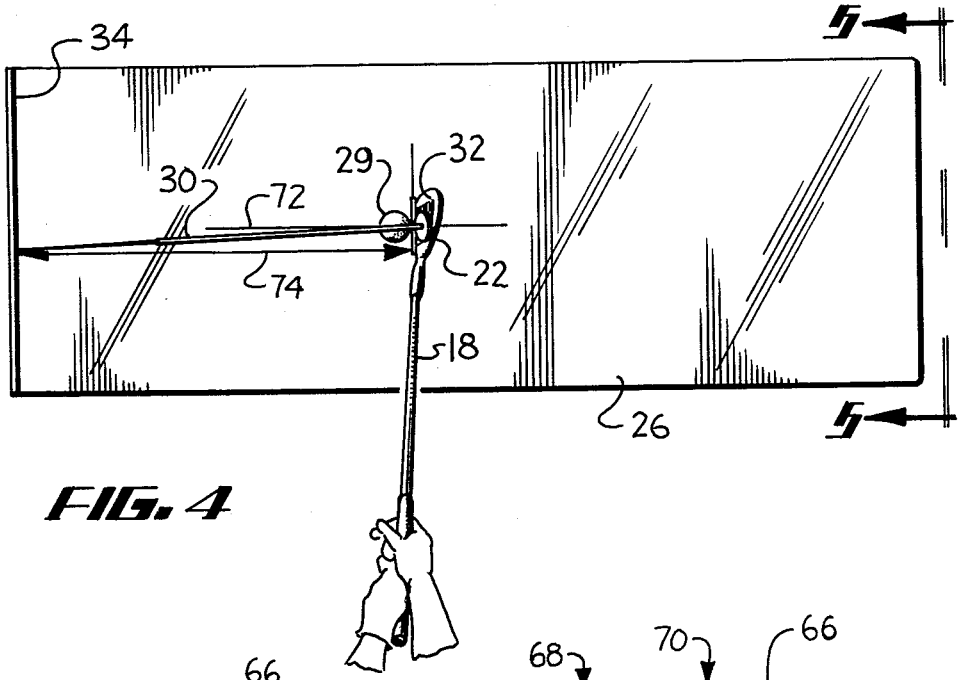
FIG. 4 is a top view of the device of FIGS. 1 and 2.
Figure 5:
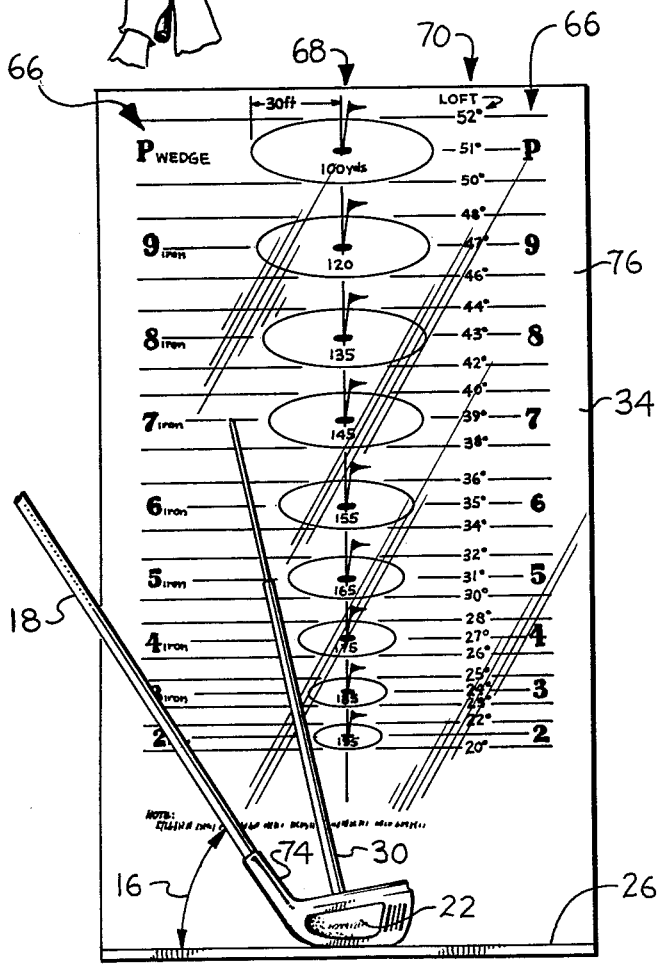
FIG. 5 is an end elevational view of the device of FIGS. 1, 2, and 4.

Normally, the pointer 30 is connected in a collapsed condition and then is extended until the point 32 touches the indicia wall portion 34 (FIG. 4). As shown in FIG. 5, the wall portion 34 includes indicia 66 indicating the normal range for a particular club, indicia 68 indicating a normal green size as it would appear to a golfer using a particular club, and indicia 70 indicating loft angles. The lie angle 16 of the club 18 is not indicated directly but instead the relative error away from a centerline 72 which is the desired direction of travel of a ball to be hit, is shown. The centerline 72 is printed on the horizontal platform 26 and the indicia wall portion 34 in alignment with a single vertical plane. Since the amount of lie error is related in a complex manner to the loft angle, the pointer 30 being off of the centerline 72 to the left as shown indicates that the lie angle should be increased, but until the loft angle is corrected, the exact magnitude of the lie problem is not indicated. For the 5 iron 18, as the loft angle 14 is reduced, increasing lie angle error will be seen. Therefore, assuming that the stance of the golfer 12 is correct, the hosel 74 of the head 22 would first be bent to correct loft angle. Thereafter the lie angle would be adjusted to bring the pointer 30 to the centerline 72. At that point, the club should be adjusted for the particular golfer 12. Although the indicia 60, 68 and 70 normally are permanently printed on the wall portion 34 and located thereon in accordance with the distance 74 and the orientation thereof to the ledge 24, they can also be printed on a piece of paper 76 attached to the wall portion 34 so that when a pen point is used for the tip 32 of the pointer 30, a record can be kept of the initial errors in club alignment. This is particularly helpful when a faulty stance is involved since it can be taken home by the golfer to remind himself of his previously learned errors in stance for particular clubs so that he can work on changing his mental picture of proper ball address when on the golf course away from the present device 10.

Therefore there has been shown and described a novel golf club loft and lie angle indicating and training device which fulfills all the objects and advantages sought therefore. Many changes, alterations, modifications and other uses and applications of the subject device will become apparent to those skilled in the art after considering this specification together with the accompanying drawings and claims. All such changes, alterations and modifications which do not depart from the spirit and scope of the invention are deemed to be covered by the invention which is limited only by the claims which follow.

What is claimed is:

1. A device for measuring the errors in loft and lie angles of the face of a golf club being held in the normal ball addressing stance by the expected user of the club including:

a base member having:

horizontal platform;

a linear abutment ledge extending upwardly from said horizontal platform adapted to engage the leading edge of the golf club and thereby fix the position of the club leading edge therebetween; and an upstanding wall positioned a predetermined distance from said linear abutment ledge having indicia of loft angle and lie angle errors thereon; and a pointer member having:

attachment means adapted to attach to the face of the club; and a pointer body which extends perpendicular to the face of the club and toward said indicia of loft and lie angle errors of said upstanding wall when said pointer member is attached to the face of a club whose leading edge is engaged with said linear abutment ledge.

2. The device defined in claim 1 wherein said attachment means include:

a cup portion attached to said pointer body;

a magnetic disc retained in said cup to supply attractive magnetic force to retain said pointer member to the club face.

3. The device defined in claim 1 wherein said attachment means include:

a cup portion attached to said pointer body;

an adhesive disc retained in said cup positioned to adhesively engage the club face and to retain said pointer member thereto.

4. The device defined in claim 1 wherein said pointer body includes:

a first elongate tubular member having first and second ends, said first end being attached to said attachment means;

a second elongate tubular member having first and second ends, said first end of said second elongate tubular member being adapted for telescoping attachment with said second end of said first elongate tubular member; and a pointer tip attached to said second end of said second elongate tubular member, said pointer tip including:

material transfer marking means for indicating any contact with said upstanding wall.

5. the device defined in claim 4 wherein said upstanding wall includes:

a removable surface having thereon said indicia, said surface being adapted to be marked by material from said material transfer marking means.

6. The device defined in claim 4 wherein said attachment means include:

a cup portion attached to said first elongate tubular member first end;

a magnetic disc retained in said cup to supply attractive magnetic force to retain said pointer member to the club face.

7. The device defined in claim 6 wherein said cup portion is constructed from material which can be magnetized by said magnetic disc.

8. The device defined in claim 1 wherein said indicia include:

golf green pictorials scaled to appear at normal golfing distances.

9. The device defined in claim 8 wherein said indicia of loft angle include:

indicia of golf clubs related thereto, said indicia of golf clubs also being related to said golf green pictorials.

10. The device defined in claim 9 wherein said indicia include:

a centerline which extends on said upstanding wall and said horizontal platform along a vertical plane intersecting said linear abutment ledge perpendicularly.

11. The device defined in claim 10 wherein said horizontal platform includes:

a golf ball pictorial positioned thereon, centered on said centerline adjacent said linear abutment ledge so that a golf club addressing said golf ball pictorial engages said linear abutment ledge.

12. The device defined in claim 11 wherein said horizontal platform is perpendicular to said upstanding wall and said linear abutment ledge is parallel to said upstanding wall.

13. A device for measuring the errors in loft and lie angles including:

a golf club having:

a face having errors in loft or lie angle when said club is being held in its normal ball addressing stance by the expected user of the club;

a leading edge adjacent said face; and a sole surface;

a base member having:

a horizontal platform engaged with said sole surface;

an abutment ledge extending upwardly from said horizontal platform engaged therealong with said leading edge of said golf club; and a upstanding wall positioned a predetermined distance from said abutment ledge having indicia of loft angle and lie angle errors thereon; and a pointer member having:

attachment means adapted to attach to said face of said golf club; and an telescoping pointer body which extends perpendicular to said face of said golf club and toward said indicia of loft and lie angle errors of said upstanding wall when said pointer member is attached to said face of said golf club.

14. The device defined in claim 13 wherein said attachment means include:

a cup portion attached to said pointer body;

a magnetic disc retained in said cup to supply attractive magnetic force to retain said pointer member to said club face.

15. The device defined in claim 14 wherein said pointer body includes:

a first elongate tubular member having first and second ends, said first end being attached to said cup portion;

a second elongate tubular member having first and second ends, said first end of said second elongate tubular member being adapted for telescoping attachment with said second end of said first elongate tubular member; and a pointer tip attached to said second end of said second elongate tubular member, said pointer tip including:

marking means for transfering material to said upstanding wall and thereby indicating any contact with said upstanding wall, and wherein said upstanding wall includes:

a removable surface having thereon said indicia, said surface being adapted to receive markings of material from said marking means.

16. The device defined in claim 13 wherein said indicia include:

golf green pictorials scaled to appear at normal golfing distances, and wherein said indicia of loft angle include:

indicia of golf clubs related thereto, said indicia of golf clubs also being related to said golf green pictorials.

17. The device defined in claim 13 wherein said indicia include:

a centerline which extends on said upstanding wall and said horizontal platform along a vertical plane intersecting said abutment ledge perpendicularly, and wherein said horizontal platform is perpendicular to said upstanding wall and said abutment ledge is parallel to said upstanding wall, said horizontal platform including:

a golf ball pictorial positioned thereon, centered on said centerline adjacent said abutment ledge so that said golf club addressing said golf ball pictorial engages said abutment ledge.

* * * * *